US005746833A

United States Patent [19]

Gerhardt

[11] Patent Number: 5,746,833

[45] Date of Patent: May 5, 1998

[54] APPARATUS FOR CONTINUOUSLY APPLYING A COATING TO A SHEET OF INDETERMINATE LENGTH

[75] Inventor: Norbert Gerhardt, Celle, Germany

[73] Assignee: TZN Forschungs- und Entwicklungszentrum Unterlüss GmbH, Unterlüss, Germany

[21] Appl. No.: 725,546

[22] Filed: Oct. 3, 1996

Related U.S. Application Data

[62] Division of Ser. No. 529,543, Sep. 18, 1995, Pat. No. 5,601,868.

[30] Foreign Application Priority Data

Sep. 16, 1994 [DE] Germany ..... 44 33 048.0

[51] Int. Cl.[6] ..... B05C 1/00

[52] U.S. Cl. ..... 118/665; 118/696; 118/712; 118/120; 118/123; 118/126

[58] Field of Search ..... 118/120, 122, 118/123, 126, 261, 410, 413, 419, 665, 696, 712

[56] References Cited

U.S. PATENT DOCUMENTS

| | | | |
|---|---|---|---|
| 1,566,358 | 12/1925 | White . | |
| 3,722,465 | 3/1973 | Krautzberger | 118/123 |
| 4,331,713 | 5/1982 | Girard et al. | 118/126 |
| 4,405,661 | 9/1983 | Alheid | 118/413 |
| 4,553,498 | 11/1985 | Sommer et al. | 118/126 |
| 5,242,498 | 9/1993 | Kohler et al. | 118/123 |

FOREIGN PATENT DOCUMENTS 33 13 972 4/1989 Germany .

*Primary Examiner*—Laura Edwards
*Attorney, Agent, or Firm*—Spencer & Frank

[57] ABSTRACT

An apparatus for continuously applying a coating to a running web, includes an elastic doctor blade having first and second ends, a frontal ride adapted to be oriented towards the web and a reverse side opposite the frontal aide and adapted to be oriented away from the web. The apparatus further has a clamping device firmly holding the doctor blade by engagement therewith in a zone of the first end. The clamping device positions the doctor blade for contacting the web at the second end along a scraping line. The apparatus also has an inflatable actuator engaging the reverse side of the doctor blade between the clamping device and the first and of the doctor blade. The actuator has a pressurized state in which a surface portion of the actuator is enlarged by an inflating fluid towards the reverse side of the doctor blade for pressing it against the web. A fluid pressure source is connected to the in inflatable actuator. A pressure control device generates in the actuator periodic fluid pressure fluctuations of predetermined frequency and magnitude to impart corresponding oscillations to the doctor blade.

10 Claims, 3 Drawing Sheets

APPARATUS FOR CONTINUOUSLY APPLYING A COATING TO A SHEET OF INDETERMINATE LENGTH

CROSS REFERENCE TO RELATED APPLICATION

This is a Division of application Ser. No. 08/529,543 filed Sep. 18, 1995, now U.S. Pat. No. 5,601,868.

Thin application claims tho priority of German Application No. P 44 33 042.0 filed Sep. 16, 1994, which is incorporated herein by reference.

BACKGROUND OF THE INVENTION

This invention relates to a method and an apparatus for continuously applying a coating of constant thickness to a web (sheet) of indefinite length with the aid of an elastic doctor blade, an edge of which presses, along a scraping line, the running web and which is, at a location spaced from that edge, firmly held by a clamping device.

To improve the quality of raw paper, it is known to coat base paper in a coating machine up to twice on each side with an appropriate substance. The substance in applied to the sheet in excess and subsequently, by means of a doctor blade, the coating is brought to the desired weight. It is a disadvantage of this conventional method that because of impurities in the coating mass, between the doctor blade and the sheet deposits may appear which result in streaks that adversely affect the quality of the paper.

U.S. Pat. No. 1,566,358 discloses an apparatus for tightening and biasing an elastic doctor blade wherein in the frontal part of the doctor blade at its side which is oriented away from the sheet a support strip with an elastic insert is provided. In order to be able to vary the pressure of the tip of the doctor blade on the ghost, the elastic insert is configured as a hose which contains a pressure medium and which is connected with a controllable pressure source. This reference does not address the problem of avoiding streaking.

German Patent No. 3,313,972 discloses an apparatus for the clamping and biasing of an elastic doctor blade of a coating apparatus. To set the bias between the clamping device and the support strip on that side of the doctor blade which in oriented toward; the sheet, a specially shaped, pressure medium-containing hose is provided. The latter, upon pressurization, presses the doctor blade in the region between the clamping device and the support strip away from the sheet so that the tip of the doctor blade situated above the support strip is pressed against the sheet. This patent too, does not discuss tho manner in which streaking may be avoided.

SUMMARY OF THE INVENTION

It is an object of the invention to provide an improved method and apparatus of the above-discussed type for a simple and economical prevention or elimination of streak-causing deposits between the doctor blade and the sheet.

This object and others to become apparent as the specification progresses, are accomplished by the invention, according to which, briefly stated, the apparatus for continuously applying a coating to a running web, includes an elastic doctor blade having first and second ends, a frontal side adapted to be oriented towards the web and a reverse aide opposite the frontal side and adapted to be oriented away from the web. The apparatus further has a clamping device firmly holding the doctor blade by engagement therewith in a zone of the first end. The clamping device positions the doctor blade for contacting the web at the second end along a scraping line. The apparatus also has an inflatable actuator engaging the reverse side of the doctor blade between the clamping device and the first end or the doctor blade. The actuator has a pressurized state in which a surface portion of the actuator is enlarged by an inflating fluid towards the reverse side of the doctor blade for pressing it against the web. A fluid pressure source is connected to the inflatable actuator. A pressure control device generates in the actuator periodic fluid pressure fluctuations of predetermined frequency and magnitude to impart corresponding oscillations to the doctor blade.

Essentially, the invention is based on the principle of imparting powerful, low-frequency oscillations to the doctor blade either at predetermined intervals or when streaking occurs on the sheet. In this manner the deposits which are present between the doctor blade and the sheet are crushed and rinsed away by the subsequently applied coating. Tests have shown that the oscillating frequency of the doctor blade should lie between 1 and 5 Hz, preferably at 2 Hz.

Particularly powerful oscillations may be generated by means or an actuator which has a hose-like component surrounding a metal guide sleeve. At the ends of the guide sleeve the hose is clamped between the sleeve and clamping rings surrounding the hose-like component. The supply of compressed air to inflate the hose-like component is effected via one of the clamping rings having a hollow space which is connected with a pressure source by means of a pressure hose.

Thereafter, the compressed air is guided through the guide sleeve and an opening in the outer wall of the guide sleeve into the intermediate space between the guide sleeve and the hose-like component. The other clamping ring is closed at its end so that compressed air may not escape therefrom.

DESCRIPTION OF THE PREFERRED EMBODIMENT

Figure 1:
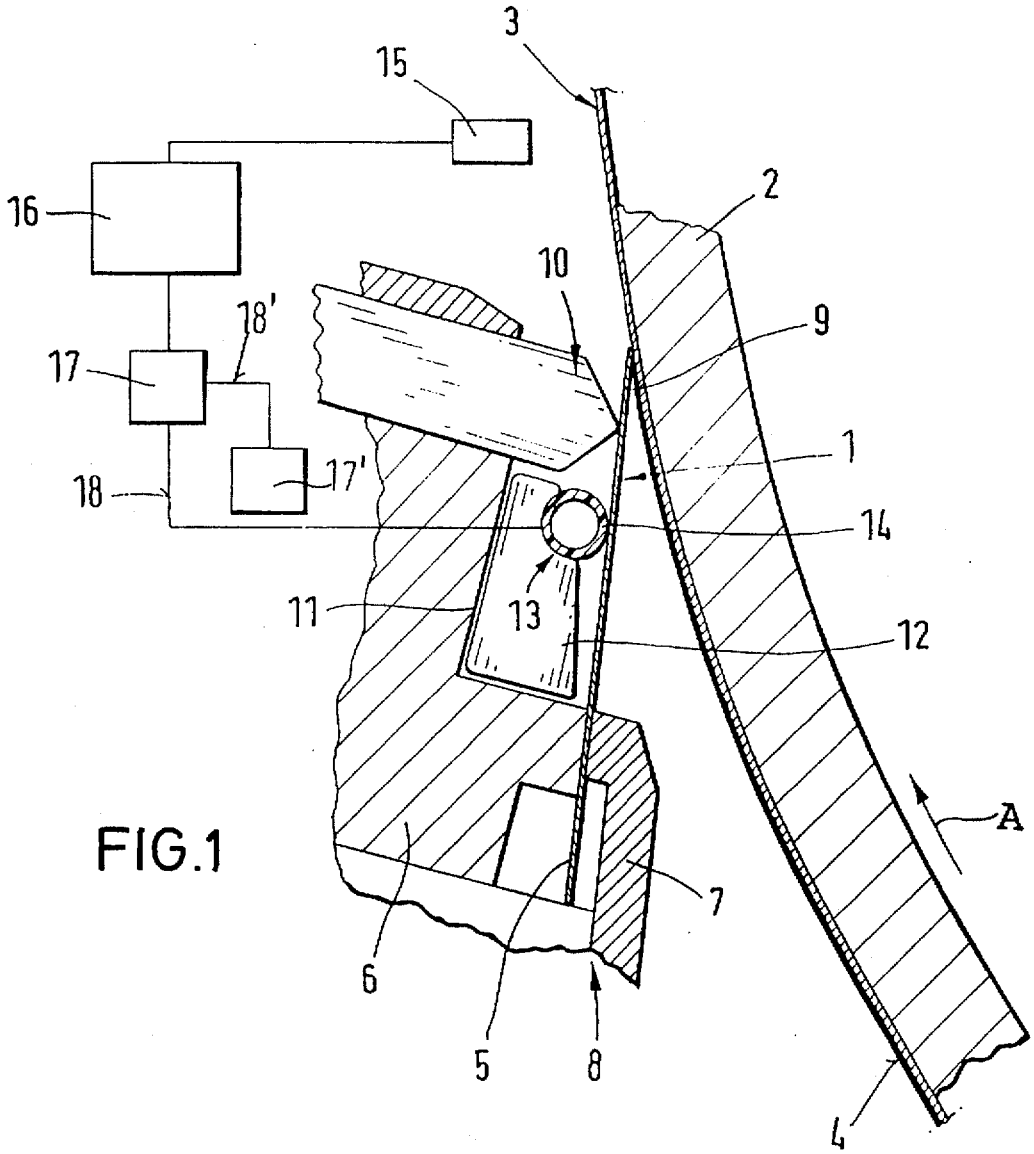
FIG. 1 in a sectional elevational view, with block diagram, of a preferred embodiment of the invention, illustrating a first operational positions

Turning to FIG. 1, there is illustrated therein a doctor blade 1 which lies against a running paper web 3 carrying an excess coating and being supported by a counterroll 2 rotating in the direction of the arrow A. The doctor blade 1 is, in the region of its and 5, firmly held by a clamping device 8 formed of a support foam 6 and a clamping bar 7. In the region of its opposite and 9 which is in engagement with the paper web 3, the doctor blade 1 is supported, on its side oriented away from the paper web, by a countermember 10 held in the support beam 6.

The support beam 6 has a recess 11 in which a filler member 12 in accommodated. The filler member 12 has a recess 13 in which an elastic element (actuator) 14 is situated which is inflatable by compressed air and which, with its side oriented away from the recess 13 of the filler member 12, lies against the doctor blade 1. In the state of the device illustrated in FIG. 1, practically no biasing forces are applied by the actuator 14 to the doctor blade 1.

If a streak detector 15, arranged adjacent the web 3 at a location downstream of the doctor blade 1 as viewed in the web advancing direction, means blade-caused streaks in the paper web 3, a control device 16, coupled to the detector 16, energizes a pressure control device 17 which causes the actuator 14 to be exposed, via a pressure line 18, with a periodically changing air pressure. The pressure control device 17 may comprises a non-illustrated pass-through solenoid valve having an inlet port coupled to a pressurized air source 17' by a pressure line 18'. An output port of the solenoid valve is connected to the pressure line 18. A timer may set alternatingly the solenoid valve into on and off positions to supply to or release pressure from the pressure line 18 in a manner known by itself. Such an on-off operation of the solenoid valve is initiated by the control device 16 upon signal from the detector 15. Instead of or in addition to tho detector 15, the control device may include a timer which periodically initiates the oscillating cycle (on-off operation) of the solenoid valve comprised in the pressure control device 17. The desired pressure magnitude (extent of valve opening), the duration of the on and off periods as well as the length of the oscillating period itself may be preset.

Figure 2:
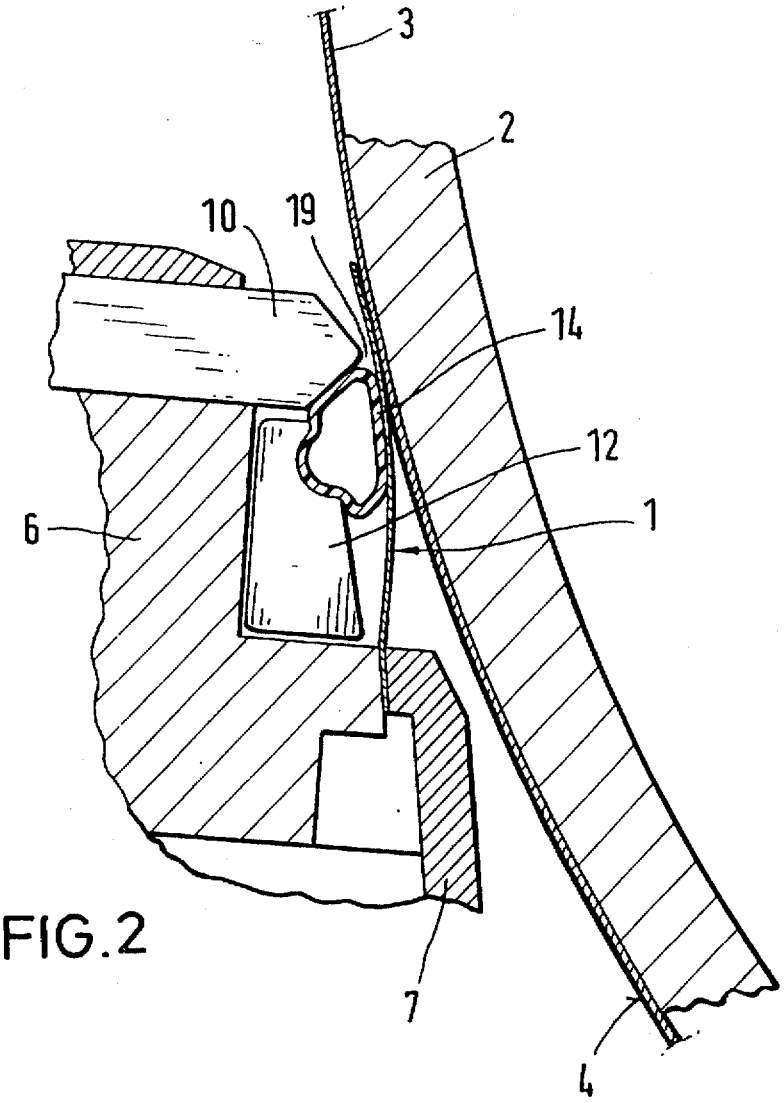
FIG. 2 is a view similar to FIG. 1, illustrating a second operational position.

FIG. 2 illustrates the state in which maximum pressure is applied to the actuator 14. Since the actuator 14 cannot expand in the direction of the filler member 12, the actuator 14 presses against the doctor blade 1 so that the contact area of the doctor blade 1 with the paper web 3 significantly increases and between the supporting countermember 10 and the doctor blade 1 an air gap 19 is formed. Impurities which are present between the forward end 9 of the doctor blade 1 and the paper web 3 are crushed by the blade 1 and are rinsed away by the coating material 4. As soon as the air pressure in reduced, the actuator 14 shrinks and the end 9 of the doctor blade 1 abuts against the support member 10.

Figure 3:
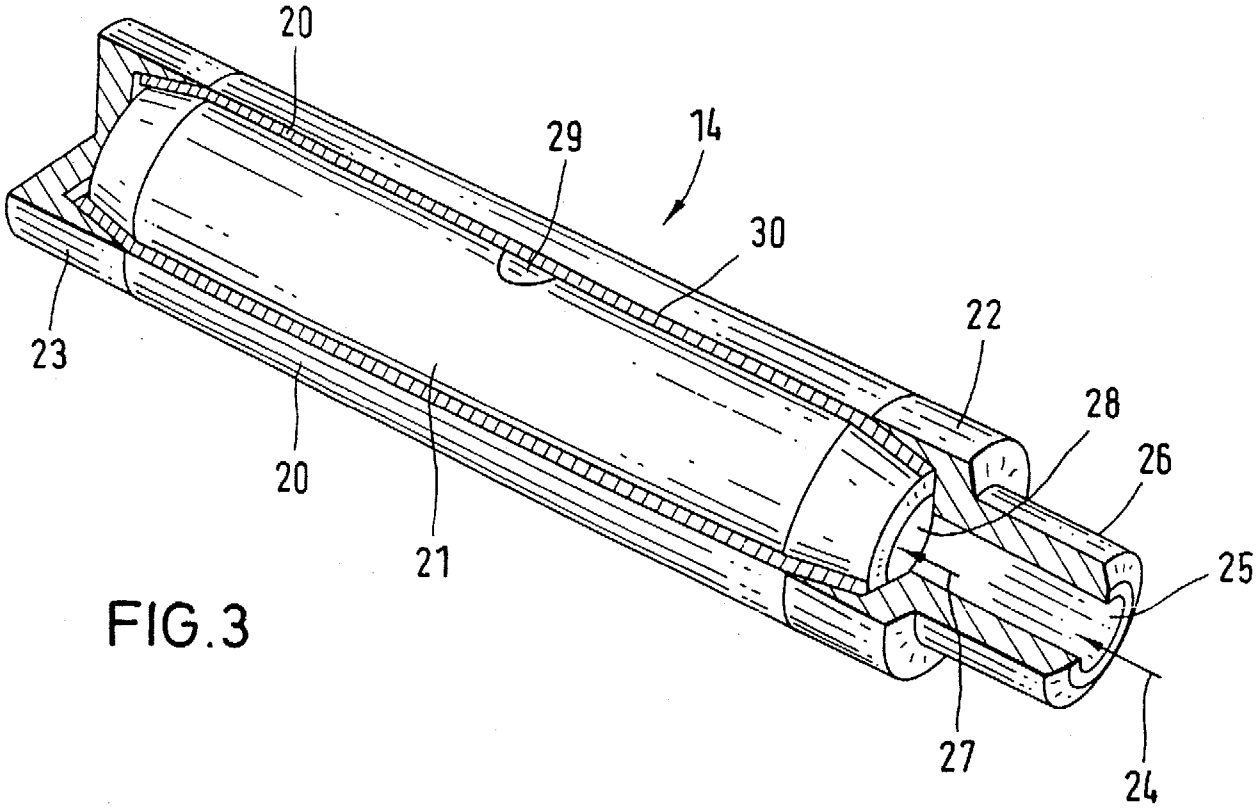
FIG. 3 a is a perspective view of a preferred embodiment of a component of the invention.

Details of a preferred embodiment of the actuator 14 are illustrated in FIG. 3. The actuator 14 comprises a hose-like component 20 which surrounds a rigid (for example, metal) guide sleeve 21. At opposite ends of the guide sleeve 21 the hose 20 is clamped between the guide sleeve 21 and sleeve-like clamping rings 22, 23 which surround the hose 20 and which may be of metal.

The supply of compressed air for inflating the hose 20 in effected in the direction of the arrow 24 via the clamping ring 22 having a hollow space 23 and further having a nipple 26 for receiving the pressure line 18 thereon (shown in FIG. 1 but not shown in FIG. 3). Thereafter, the compressed air proceeds in the direction of the arrow 27 into the inner chamber 21 of the guide sleeve 21 and therefrom, through an opening 29 in the side wall 30 of the guide sleeve 21, into the external space defined between the guide sleeve 21 and the hose 20. In this manner the inner wall of the actuator 14 is exposed to the pressure of the compressed air, The second clamping ring 23 is closed off at its rear terminus an that pressurized air may not escape on this ride of the actuator 14.

In order to ensure a highly satisfactory clamped seat of the hose 20, the ends or the guide sleeve 21 as well as the corresponding inner walls of the clamping rings 22, 23 are of conical configuration.

It will be understood that the above description of the present invention is susceptible to various modifications, changes and adaptations, and the same are intended to be comprehended within the meaning and range of equivalents of the appended claims.

What is claimed is:

1. An apparatus for continuously applying a coating to a running web, comprising (a) an elastic doctor blade having first and second ends, a frontal side and a reverse side opposite said frontal side; during operation said frontal side being oriented towards the web and said reverse side being oriented away from the web;

(b) a clamping device firmly holding said doctor blade by engagement therewith in a zone of said first end; said clamping device positioning said doctor blade for contacting the web at said second end along a scraping line;

(c) an inflatable actuator engaging said reverse side between said clamping device and said first end of said doctor blade; said actuator having a pressurized state in which a surface portion of said actuator is enlarged by an inflating fluid towards said reverse side for pressing said doctor blade against the web; said actuator including (1) a guide sleeve having opposite first and second ends and an inner chamber;

(2) an elastic hose enclosing said guide sleeve;

(3) first and second clamping rings tightening said hose to said guide sleeve at said first and second ends, respectively;

(4) a nipple extending from said first clamping ring; and (5) means for maintaining fluid communication between said nipple and said elastic hose;

(d) a fluid pressure source; and (e) pressure control means for generating in said actuator periodic fluid pressure fluctuations of predetermined frequency and magnitude to impart corresponding oscillations to said doctor blade; said pressure control means being connected to said fluid pressure source and having a pressure line extending to said actuator; said nipple of said actuator being attached to said pressure line.

2. The apparatus as defined in claim 1, wherein said fluid pressure source is a pneumatic pressure source.

3. The apparatus an defined in claim 1, wherein said means for maintaining fluid communication includes an opening at said first; end of said guide sleeve for communications with said, inner chamber thereof and an opening in a side wall of said guide sleeve; said inflatable hose being exposed to pressure in said inner chamber through said opening in said side wall.

4. The apparatus as defined in claim 3, wherein said second clamping ring has a closed bottom.

5. The apparatus as defined in claim 1, wherein said clamping device comprises a supporting countermember for engaging said reverse side of said doctor blade; said inflatable actuator being situated between said first and of said doctor blade and said supporting countermember.

6. The apparatus as defined in claim 5, wherein said clamping device further comprises (a) a support beam; said countermember being hold by said support beam; and (b) a clamping bar tightening said first and of said doctor blade to said support beam; said inflatable actuator being situated between said clamping bar and said supporting countermember.

7. An apparatus for continuously applying a coating to a running web, comprising (a) an elastic doctor blade having first and second ends, a frontal side and a reverse side opposite said frontal side; during operation said frontal side being oriented towards the web and said reverse side being oriented away from the web;

(b) a clamping device firmly holding said doctor blade by engagement therewith in a zone of said first end; said clamping device positioning said doctor blade for contacting the web at said second end along a scraping line;

(c) an inflatable actuator engaging said reverse side between said clamping device and said first end of said doctor blade; said actuator having a pressurized state in which a surface portion of said actuator is enlarged by an inflating fluid towards said reverse side for pressing said doctor blade against the web;

(d) a fluid pressure source; and (e) pressure control means connected to said fluid pressure source and said inflatable actuator for generating in said actuator periodic fluid pressure fluctuations of predetermined frequency and magnitude to impart corresponding oscillations to said doctor blade; said pressure control means including a detector sensing streaking of the coating on the web for initiating said pressure fluctuations.

8. The apparatus as defined in claim 7, wherein said fluid pressure source is a pneumatic pressure source.

9. The apparatus as defined in claim 7, wherein said clamping device comprises a supporting countermember for engaging said reverse side of said doctor blade; said inflatable actuator being situated between said first end of said doctor blade and said supporting countermember.

10. The apparatus as defined in claim 9 wherein said clamping device further comprises (a) a support beam; said countermember being held by said support beam; and (b) a clamping bar tightening said first end of said doctor blade to said support beam; said inflatable actuator being situated between said clamping bar and said supporting countermember.

* * * * *